US005884710A

United States Patent [19]

Barnes et al.

[11] Patent Number: 5,884,710

[45] Date of Patent: Mar. 23, 1999

[54] LIQUID PYROTECHNIC FIRE EXTINGUISHING COMPOSITION PRODUCING A LARGE AMOUNT OF WATER VAPOR

[75] Inventors: Michael W. Barnes, Brigham City; Guy R. Letendre, Ogden; Brett Hussey, Bountiful, all of Utah

[73] Assignee: Autoliv ASP, Inc., Ogden, Utah

[21] Appl. No.: 888,378

[22] Filed: Jul. 7, 1997

[51] Int. Cl.[6] ..... B05B 13/02

[52] U.S. Cl. ..... 169/46; 169/12; 169/84

[58] Field of Search ..... 169/46, 47, 12, 169/9, 6, 84

[56] References Cited

U.S. PATENT DOCUMENTS

| | | | |
|---|---|---|---|
| 1,588,234 | 6/1926 | Kauch et al. | 169/84 X |
| 3,833,063 | 9/1974 | Williams | 169/36 X |
| 4,285,403 | 8/1981 | Poland | 169/36 X |
| 5,060,973 | 10/1991 | Giovanetti | 280/736 |
| 5,223,057 | 6/1993 | Mueller et al. | 149/45 |
| 5,465,795 | 11/1995 | Galbraith et al. | 169/11 |
| 5,609,210 | 3/1997 | Galbraith et al. | 169/84 X |

*Primary Examiner*—Kevin Weldon
*Attorney, Agent, or Firm*—George W. Rauchfuss, Jr.

[57] ABSTRACT

Fire extinguishing or suppression apparatus and method employing a liquid pyrotechnic composition of a ternary mixture of hydroxyl ammonium nitrate, an amine nitrate salt, and water, in a closed combustion chamber of a pressure container. The apparatus is constructed to permit a large volume of water vapor exothermically generated by the reaction of a liquid pyrotechnic composition to be discharged from the combustion chamber and pressure container to an area of a fire.

20 Claims, 2 Drawing Sheets

LIQUID PYROTECHNIC FIRE EXTINGUISHING COMPOSITION PRODUCING A LARGE AMOUNT OF WATER VAPOR

FIELD OF THE INVENTION

This invention relates to a fire suppressing composition, apparatus and method for suppressing or extinguishing a fire. More particularly, this invention relates to a liquid pyrotechnic composition producing high levels of water vapor and apparatus and method for suppressing or extinguishing a fire.

BACKGROUND OF THE INVENTION

Typically, fires involve a chemical reaction between oxygen and a fuel which is raised to its ignition temperature by heat. In general, suppression or extinguishment of fires has involved one or more of the following procedures: removing the oxygen, reducing the temperature in the environment of the fire, physically separating the oxygen from the fuel and/or interruption of the chemical reactions of the components. A number of means of accomplishing the foregoing methods are known. Physical agents operate primarily on heat absorption and chemical agents operate primarily by removing free radicals from the flames and the combustion system. Among the agents employed there may be mentioned water, carbon dioxide, dry chemicals and Halon halocarbons.

Although Halon halocarbons have been used extensively in the past, there is a need to eliminate their use due to the harmful effects they are considered to have on the environment, particularly their zone depleting aspect with respect to the atmosphere.

Due to the necessity for large cylinders to contain a very limited amount of carbon dioxide gas, use of carbon dioxide has been very restricted.

Probably the most commonly used fire suppressing material has been water. Heretofore, water-based indoor fire suppression has generally been in the form of water sprinkler systems which generally operate at ordinary building or municipal water pressure. These systems depend upon distributing a plurality of sprinkler heads around an area to be protected. Such systems can be relatively complex and expensive, requiring piping interconnecting the sprinkler heads and running to a suitable source of water, which is normally at the pressure provided in the facility or building, or the municipal or other provider of water pressure, that is, a relatively low pressure.

A more recently emerging technology in fire protection is to use some form of water mist system. Such systems use relatively small amounts of water in the form of a fine mist to extinguish a fire rather than the relatively large volume of water that an ordinary sprinkler system would typically distribute or apply. A water mist operates to extinguish a fire by at least two different mechanisms, namely, by extracting heat and by displacing oxygen. Such systems use relatively small amounts of water in the form of a fine mist of very small (e.g. 50 microns) water droplets to extinguish fires.

The vaporization of water to steam is very effective in removing heat from the fire. Again, however, one of the drawback to the use of water is the limited amount of water that can be conveniently stored for use in fire suppression systems. A further drawback has been the necessity, in some situations, to provide expensive means for converting the stored water to water vapor for use in suppressing a fire by oxygen displacement.

SUMMARY OF THE INVENTION

It is therefore an object of this invention to provide fire extinguishing or suppressing apparatus or systems that store a liquid composition for producing a large volume of dispensable water vapor compared to the volume of the stored composition.

A further object of this invention is to provide a system of such compositions capable of producing a large amount of water vapor which can be stored for long periods of time until it needs to be employed to extinguish or suppress a fire.

An additional object of this invention is to provide a system, including such a liquid composition, which is not ozone depleting with respect to the atmosphere. A still further object of this invention is to provide such a system including a liquid composition that not only produces a large amount of water but produces the water as water vapor so that condensation of the water vapor prior to reaching the fire will provide a water mist that, when in contact with the fire, evaporates to water vapor thereby not only providing for oxygen displacement but also removal of a large quantity of heat energy due to the latent heat of vaporization.

Yet another object of this invention is to provide such liquid fire extinguishing or suppressing composition which can be stored in a relatively small sized combustion chamber and the combustion products can be readily directed to the area of a fire by the use of appropriate piping, conduits and/or nozzles, and the combustion chamber can be readily moved from location to location as needed.

One or more of the foregoing objects are obtained in accordance with this invention by the use of a liquid pyrotechnic composition stored in a combustion chamber similar to automobile airbag inflators for exothermically generating a large volume of water vapor which is inherently free of potentially harmful byproducts. The large volume of water vapor produced by the exothermic reaction in the combustion chamber can be ducted to the area of the fire by appropriate piping and nozzles.

The liquid pyrotechnic compositions used in the apparatus and method of this invention comprises a ternary mixture of hydroxyl ammonium nitrate oxidizer, an amine nitrate salt fuel and water as a diluent or solvent.

BRIEF DESCRIPTION OF THE DRAWINGS

The invention is illustrated by, but not limited to, the embodiments of the invention disclosed in the drawings in which.

DETAILED DESCRIPTION OF THE INVENTION

Figure 1:
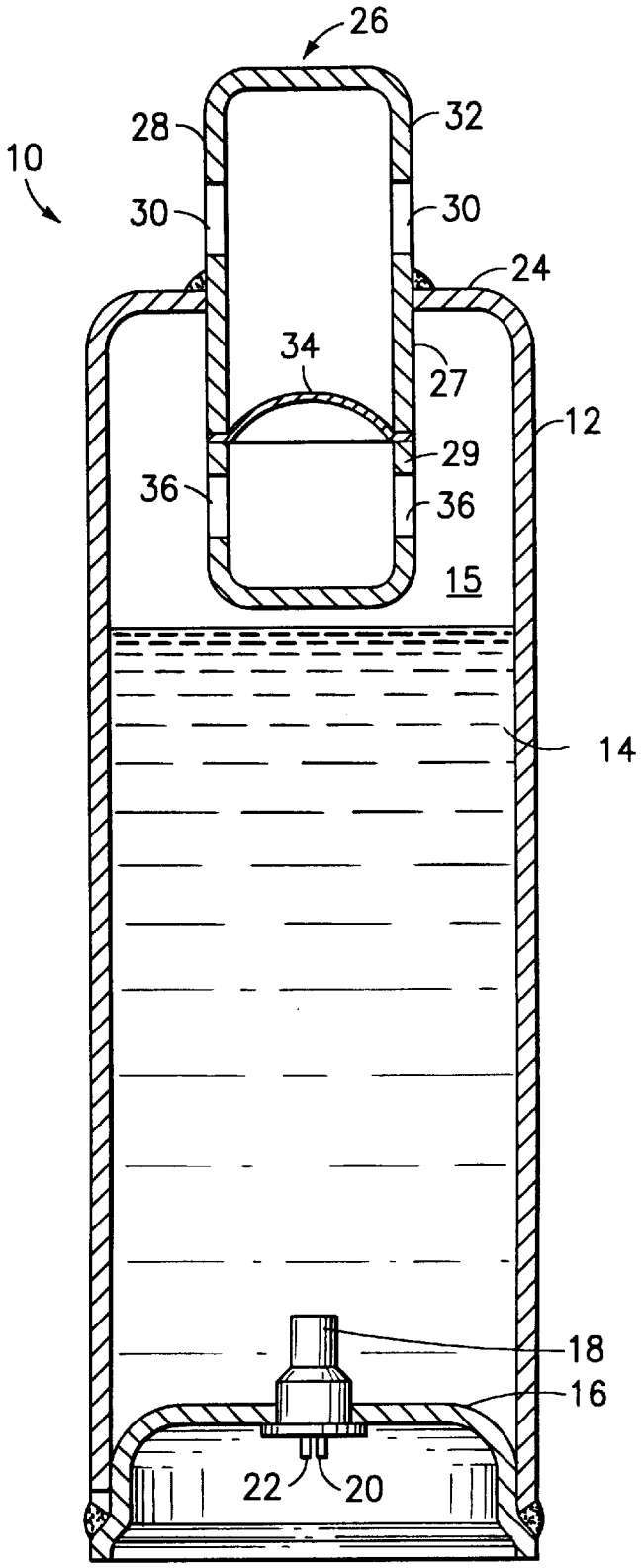
FIG. 1 is a cross-sectional view of a fire extinguishing apparatus containing a liquid propellant composition of this invention.

The purpose of this invention is accomplished by employing a liquid pyrotechnic composition of a ternary mixture of hydroxyl ammonium nitrate, an amine nitrate, and water as a diluent or solvent in a combustion chamber that is suitable for use as fire extinguisher by permitting expulsion from the combustion chamber of a large volume of water vapor exothermically generated by the reaction of the ternary mixture.

The liquid pyrotechnic composition can comprise any suitable ternary mixture of an amine nitrate salt with the hydroxyl ammonium nitrate and water. Any suitable amine nitrate salt may be employed in the liquid pyrotechnic composition, generally an alkyl ammonium nitrate or an alkanol ammonium nitrate, preferably an alkanol ammonium nitrate. Any suitable alkyl ammonium nitrate, such as triethyl ammonium nitrate, triisopropyl ammonium nitrate or the like and any alkanol ammonium nitrate, such as triethanol ammonium nitrate, tripropanol ammonium nitrate or the like. Especially preferred is triethanol ammonium nitrate.

The reaction of the aqueous solution of hydroxyl ammonium nitrate and the amine nitrate, when initiated, exothermically generates as reaction product gases comprising proportionately relatively small amounts of nitrogen and carbon dioxide and relatively large amounts of water vapor, and no particulate byproducts.

The aqueous ternary mixture will generally comprise from about 40% to about 60% by weight hydroxyl ammonium nitrate, from about 10% to about 20% by weight of amine nitrate salt and from about 20% to about 40% by weight water. An especially preferred liquid pyrotechnic formulation comprises, by weight, about 53.21% hydroxyl ammonium nitrate, about 16.79% triethanol ammonium nitrate and about 30% water. The preferred pyrotechnic composition comprising 100 grams of a stoichiometric mixture (53.21/16.79/30) should result in the production of moles of gas products: water 3.41 moles, nitrogen 0.633 mole and carbon dioxide 0.474 mole at a combustion chamber temperature of 1749° Kelvin (1476° C.).

A fire extinguishing apparatus of this invention utilizing a liquid pyrotechnic water vapor-generating composition of this invention is illustrated in the drawings.

A pressure bottle designated generally by the reference numeral 10 is illustrated. The pressure bottle 10 can be of the general type employed as inflators in airbag modules. The pressure bottle includes a tubular container or cylinder 12 which houses a quantity of the liquid pyrotechnic ternary mixture 14 in a combustion chamber 15. The pressure bottle 10 is closed at both ends.

In one endwall 16, generally a cup-shaped endwall, there is mounted an initiator or squib 18. The initiator 18, upon occurrence of a suitable signal, preferably an electrical signal from a sensor (not shown), through internal lead wires 20 and 23, provides, generally by electrical energy, sufficient heat to initiate reaction of liquid pyrotechnic composition 14 to produce the reaction products which comprise a greatly increased amount of water vapor.

In the other endwall 24, opposite endwall 16, there is mounted a diffuser housing 26. A portion 27 of diffuser housing 26 extends from endwall 24 into combustion chamber 15 and another portion 28 of the diffuser housing extends externally from the endwall. Preferably, the diffuser housing 26 is a tubular housing as illustrated but can be of any suitable shape and design.

A plurality of exit ports 30 communicating with the atmosphere are arranged, preferably radially, circumferentially around sidewall 32 of external portion 28. In internal portion 27 there is arranged a frangible burst disk 34 which interrupts the flow path from isolation combustion chamber 15 to exit port 30 until the burst disk is ruptured. The wall, preferably sidewall 29, of internal portion 27 can also be provided with radial flow control ports 36 providing access from combustion chamber 15 to burst disk 34. However, such flow control ports are not required and burst disk 34 could constitute an endwall of internal portion 27.

Upon initiation of the reaction of liquid pyrotechnic composition 14 by initiator 18, the ternary mixture reacts to form a large volume of water vapor, thereby increasing the pressure in combustion chamber 15 until burst disk 34 ruptures and opens the flow path from the combustion chamber to exit ports 30 for release of the water vapor to the area of a fire.

Figure 2:
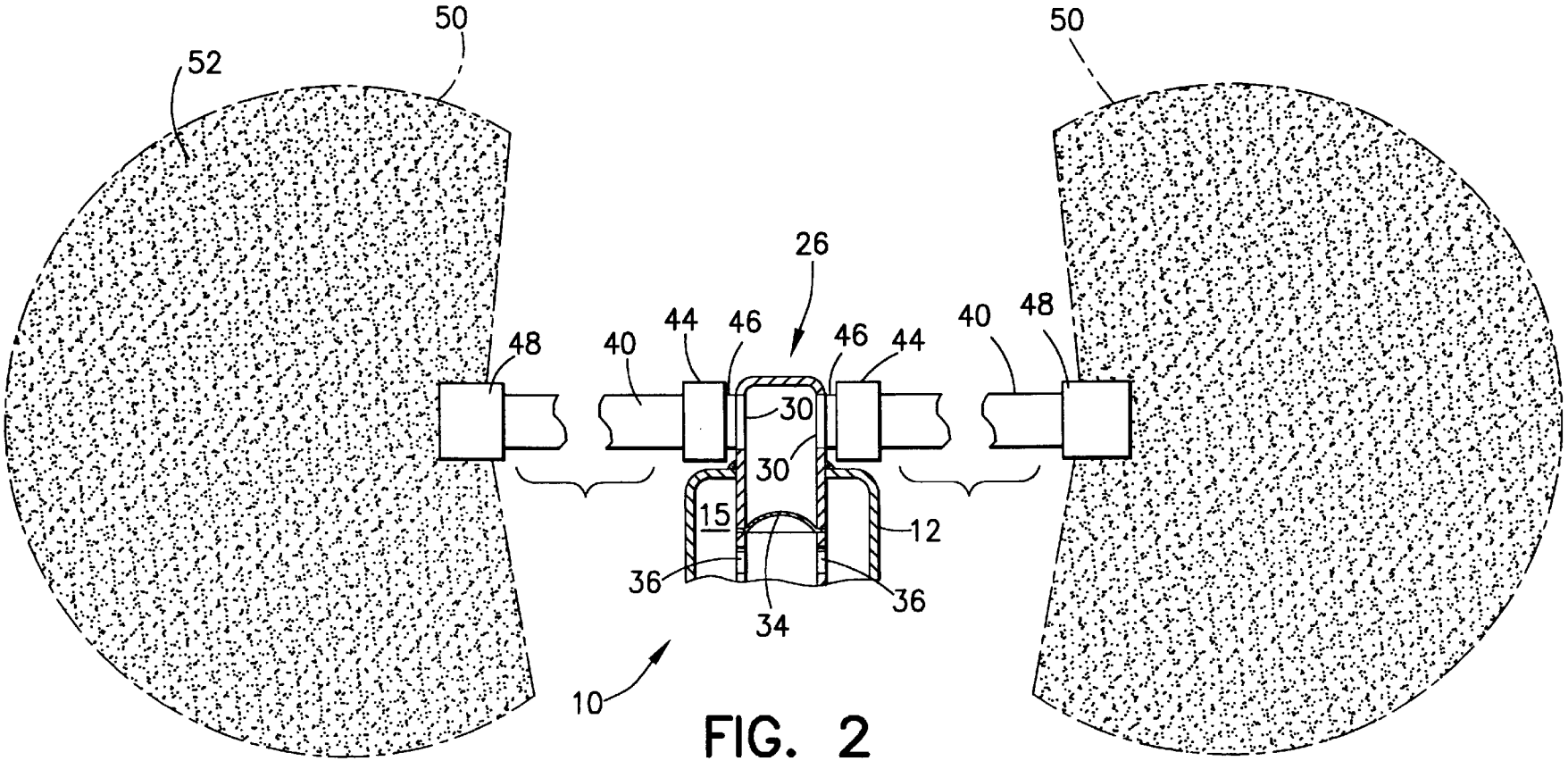
FIG. 2 is a simplified partial cross-sectional view of another fire extinguishing apparatus in which the apparatus is provided with discharge tubing for providing a desired dispersal pattern for dispersal of water vapor from the extinguisher apparatus.

Another feature of this invention is illustrated in the simplified view of FIG. 2 showing a partial view of a fire extinguisher 10 of this invention. The fire extinguisher 10 has discharge conduit or tubing 40 connected to the exit ports 30 of the extinguisher. The discharge tubing 40 is preferably flexible tubing and is connected by fitting 44 on coupling 46 attached to the diffuser port 30, such as by being welded thereto or threaded therein. At the discharge end of the tubing 40, the tubing is provided with a nozzle 48 selected to give the desired or predetermined dispersal pattern 50 of the water vapor 52 and other reaction product gases generated exothermically from the liquid pyrotechnic composition 14.

With the foregoing description of the invention, those skilled in the art will appreciate that modifications may be made to the invention without departing from the spirit thereof. Therefore, it is not intended that the scope of the invention be limited to the specific embodiments illustrated and described.

We claim:

1. A fire extinguishing or suppressing apparatus comprising:

a pressure container defining an enclosed combustion chamber housing a liquid pyrotechnic mixture of hydroxyl ammonium nitrate, an amine nitrate salt and water;

initiation means mounted on said pressure container for initiating reaction of said liquid pyrotechnic mixture to produce reaction products comprising a large proportion of water vapor for extinguishing or suppressing a fire; and a diffuser housing mounted on a wall of said pressure container, a first portion of said diffuser housing extending internally from said wall into the combustion chamber and a second portion of said diffuser housing extending externally from said wall, said second portion defining at least one exit port for release of reaction products of the liquid pyrotechnic composition, said first portion of the diffuser housing having frangible burst means positioned therein for blocking a flow path from the combustion chamber to the at least one exit port until the frangible burst means is ruptured.

2. Apparatus according to claim 1 wherein the liquid pyrotechnic mixture comprises from about 40% to about 60% by weight hydroxyl ammonium nitrate, from about 10% to about 20% by weight amine nitrate salt and from about 20% to about 40% by weight water.

3. Apparatus according to claim 2 wherein the amine nitrate salt is selected from an alkyl ammonium nitrate and an alkanol ammonium nitrate.

4. Apparatus according to claim 3 wherein the amine nitrate salt comprises an alkanol ammonium nitrate.

5. Apparatus according to claim 4 wherein the alkanol ammonium nitrate comprises triethanol ammonium nitrate.

6. Apparatus according to claim 5 wherein the liquid pyrotechnic composition comprises about 53.21% by weight hydroxyl ammonium nitrate, about 16.79% by weight triethanol ammonium nitrate and about 30% by weight water.

7. Apparatus according to claim 2 wherein the frangible burst means comprises a burst disk rupturable by pressure produced by the reaction products of the liquid pyrotechnic composition, the at least one exit port comprises a plurality of exit ports extending circumferentially around a tubular sidewall of the second portion of the diffuser housing, and the initiation means comprises an electrically actuated squib.

8. Apparatus according to claim 7 wherein a wall of second portion of the diffuser housing defines at least one flow control port for providing access from the combustion chamber to the burst disk.

9. Apparatus according to claim 7 wherein a discharge conduit extends from each of said at least one exit port.

10. Apparatus according to claim 9 wherein the discharge conduit has dispersal means attached to a discharge end of each of said conduit for providing a dispersal pattern for discharge of the reaction products.

11. A method of extinguishing or suppressing a fire comprising:

reacting in a closed combustion chamber of a pressure container a liquid pyrotechnic mixture of hydroxyl ammonium nitrate, an amine nitrate salt and water to produce reaction products comprising a relatively large proportion of water vapor; and discharging the reaction products from the combustion chamber and pressure container to an area of the fire.

12. A method according to claim 11 wherein the liquid pyrotechnic mixture comprises from about 40% to about 60% by weight hydroxyl ammonium nitrate, from about 10% to about 20% by weight amine nitrate salt and from about 20% to about 40% by weight water.

13. A method according to claim 12 wherein the amine nitrate salt is selected from an alkyl ammonium nitrate and an alkanol ammonium nitrate.

14. A method according to claim 13 wherein the amine nitrate salt comprises an alkanol ammonium nitrate.

15. A method according to claim 14 wherein the alkanol ammonium nitrate comprises triethanol ammonium nitrate.

16. A method according to claim 15 wherein the liquid pyrotechnic composition comprises about 53.21% by weight hydroxyl ammonium nitrate, about 16.79% by weight triethanol ammonium nitrate and about 30% by weight water.

17. A method according to claim 11 wherein the reaction products are discharged from the pressure container through at least one discharge conduit having dispersal means connected at an end of each of said at least one discharge conduit for providing a dispersal pattern for discharge of the reaction products.

18. A method according to claim 12 wherein the reaction products are discharged from the pressure container through at least one discharge conduit having dispersal means connected at an end of each of said at least one discharge conduit for providing a dispersal pattern for discharge of the reaction products.

19. A method according to claim 13 wherein the reaction products are discharged from the pressure container through at least one discharge conduit having dispersal means connected at an end of each of said at least one discharge conduit for providing a dispersal pattern for discharge of the reaction products.

20. A method according to claim 16 wherein the reaction products are discharged from the pressure container through at least one discharge conduit having dispersal means connected at an end of each of said at least one discharge conduit for providing a dispersal pattern for discharge of the reaction products.

* * * * *